US008599187B2

(12) United States Patent
Sung et al.

(10) Patent No.: US 8,599,187 B2
(45) Date of Patent: Dec. 3, 2013

(54) ORGANIC LIGHT-EMITTING DISPLAY DEVICE

(75) Inventors: Si-Duk Sung, Yongin (KR); In-Hwan Ji, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 151 days.

(21) Appl. No.: 12/980,639

(22) Filed: Dec. 29, 2010

(65) Prior Publication Data

US 2011/0267329 A1 Nov. 3, 2011

(30) Foreign Application Priority Data

Apr. 30, 2010 (KR) ..... 10-2010-0040809

(51) Int. Cl.
*G09G 5/00* (2006.01)

(52) U.S. Cl.
USPC ..... 345/211; 345/76

(58) Field of Classification Search
USPC ..... 345/211
See application file for complete search history.

(56) References Cited

U.S. PATENT DOCUMENTS

| | | | | |
|---|---|---|---|---|
| 7,642,998 | B2 | 1/2010 | Mori et al. | |
| 2003/0067434 | A1 * | 4/2003 | Haga et al. | 345/98 |
| 2005/0127818 | A1 * | 6/2005 | Ohtani | 313/500 |
| 2005/0231124 | A1 * | 10/2005 | Choi et al. | 315/169.3 |
| 2006/0164336 | A1 * | 7/2006 | Yang et al. | 345/60 |
| 2006/0164366 | A1 * | 7/2006 | Yu et al. | 345/98 |
| 2008/0036435 | A1 * | 2/2008 | Watanabe et al. | 323/271 |
| 2008/0036957 | A1 * | 2/2008 | Hsu et al. | 349/151 |
| 2008/0094325 | A1 * | 4/2008 | Kim et al. | 345/87 |
| 2009/0058311 | A1 * | 3/2009 | Eom | 315/173 |
| 2009/0184899 | A1 * | 7/2009 | Kim et al. | 345/76 |
| 2009/0207106 | A1 | 8/2009 | Mizukoshi et al. | |
| 2010/0007596 | A1 * | 1/2010 | Cho et al. | 345/98 |

FOREIGN PATENT DOCUMENTS

| | | | |
|---|---|---|---|
| JP | 10026955 | | 1/1998 |
| JP | 2003114413 | A * | 4/2003 |
| JP | 2007122979 | | 5/2007 |
| KR | 1020050090709 | | 9/2005 |
| KR | 1020060056127 | | 5/2006 |
| KR | 100859655 | B1 | 9/2008 |

OTHER PUBLICATIONS

Ma, "Robust Multiple-Phase Switched-Capacitor DC-DC Converter with Digital interleaving Regulation Scheme", ISLPED'06, Oct. 4-6, 2006, Tegernsee, Germany, pp. 400-405.*

Korean Office Action issued by KIPO on Sep. 27, 2011 in connection with Korean Patent Application Serial No. 10-2010-0040809 and Request for Entry of the Accompanying Office Action attached herewith.

Korean Notice of Allowance issued by KIPO on Sep. 19, 2012 in connection with Korean Patent Application No. 10-2010-0040809 and Request for Entry of the Accompanying Office Action attached herewith.

* cited by examiner

*Primary Examiner* — Dorothy Harris
(74) *Attorney, Agent, or Firm* — Robert E. Bushnell, Esq.

(57) ABSTRACT

An organic light-emitting display device that increases long range uniformity (LRU). The organic light-emitting display device includes an image display unit including a plurality of pixels defined by a plurality of scan lines and a plurality of data lines, a plurality of film type connection devices electrically connected to the image display unit and at least one DC-DC converter arranged on the plurality of film type connection devices to supply driving voltages to the image display unit.

17 Claims, 5 Drawing Sheets

ORGANIC LIGHT-EMITTING DISPLAY DEVICE

CLAIM OF PRIORITY

This application makes reference to, incorporates the same herein, and claims all benefits accruing under 35 U.S.C. §119 from an application for ORGANIC LIGHT-EMITTING DISPLAY DEVICE earlier filed in the Korean Intellectual Property Office on Apr. 30, 2010 and there duly assigned Serial No. 10-2010-0040809.

BACKGROUND OF THE INVENTION

1. Field of the Invention

The present invention relates to an organic light-emitting display device.

2. Description of the Related Art

A variety of flat panel displays (FPDs), such as liquid crystal displays (LCDs), field emission displays (FEDs), plasma display panels (PDPs), organic light-emitting displays, or the like, have been developed to reduce the weight and volume of cathode ray-tube (CRT) display devices. Among these flat panel display devices, the organic light-emitting display device displays an image using an organic light-emitting diode (OLED) which generates light through a recombination of electrons and holes. The organic light-emitting display device has a wide range of applications, such as PDAs, MP3 players, cellular phones, digital cameras, etc., owing to various advantages thereof such as excellent coloring and thinness.

SUMMARY OF THE INVENTION

The present invention provides an organic light-emitting display device for increasing long range uniformity (LRU).

According to an aspect of the present invention, there is provided an organic light-emitting display device that includes an image display unit including a plurality of pixels defined by a plurality of scan lines and a plurality of data lines, a plurality of film type connection devices electrically connected to the image display unit and at least one DC-DC converter arranged on the plurality of film type connection devices to supply driving voltages to the image display unit.

The at least one DC-DC converter may supply a first power voltage and a second power voltage to the image display unit. The at least one DC-DC converter may be electrically connected to a power generation unit, the at least one DC-DC converter may raise or invert a voltage input from the power generation unit and to generate the first power voltage and the second power voltage. The at least one DC-DC converter may be mounted on the plurality of film type connection devices to correspond to a center of the image display unit. The at least one DC-DC converter may be mounted on the plurality of film type connection devices to correspond to an edge of the image display unit. The at least one DC-DC converter includes a plurality of DC-DC converters, and each of the plurality of DC-DC converters performs a phase control operation by supplying identical voltages and identical currents to the image display unit, respectively. The at least one DC-DC converter may control the first power voltage and the second power voltage that are supplied to the image display unit and to maintain static voltages. The plurality of film type connection devices may be one of flexible printed circuit boards (FPCBs) and tape carrier packages (TCPs). The image display unit may be included in a large size display panel of greater than 40 inches. The at least one DC-DC converter may include a first, a second, a third and a fourth DC-DC converter, the plurality of film type connection devices comprises a first and a second film type connection devices. An output voltage waveform of the second DC-DC converter may be phase delayed by 90 degrees compared to an output voltage waveform of the first DC-DC converter.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
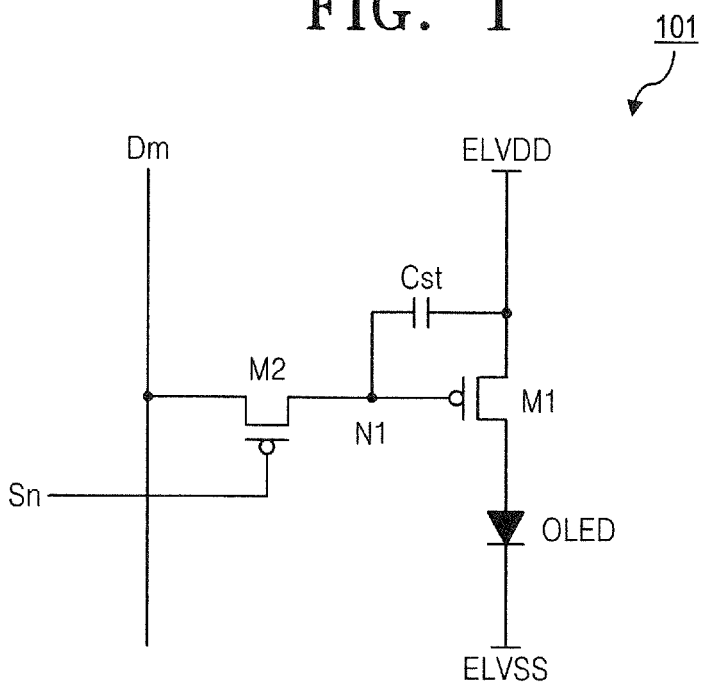
FIG. 1 is a circuit diagram of a pixel circuit employed in an organic light-emitting display device.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed within the present invention. In the description of the present invention, certain detailed explanations of related art are omitted when it is deemed that they may unnecessarily obscure the essence of the invention.

While such terms as "first" and "second" etc., may be used to describe various components, such components must not be limited to the above terms. The above terms are used only to distinguish one component from another.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having", etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Functional aspects may be implemented in algorithms that execute on one or more processors. Furthermore, the present invention could employ any number of conventional techniques for electronics configuration, signal processing and/or control, data processing and the like. The words "mechanism" and "element" are used broadly and are not limited to mechanical or physical embodiments, but can include software routines in conjunction with processors, etc.

Hereinafter, embodiments of the present invention will be described more fully with reference to the accompanying drawings. The detailed description and the drawings are introduced to provide understanding of the present invention and the detailed descriptions of well-known technologies may be omitted. In addition, the specification and the drawing are not provided to limit the scope of the present invention and the scope of the present invention is defined by the claims. The terminologies used herein are for the purpose of describing embodiments well and thus may be interpreted to correspond to the meaning and concept of the present invention.

Although an organic light-emitting display device is exemplified in the embodiments of the present invention, the present invention is not limited thereto. That is, the technical idea of the present invention can be applied to a variety of flat panel display devices.

Turning now to FIG. 1, FIG. 1 is a circuit diagram of a pixel circuit 101 employed in an organic light-emitting display device. Referring to FIG. 1, the pixel circuit 101 includes a first transistor M1, a second transistor M2, a capacitor Cst, and an organic light-emitting diode (OLED).

A source terminal of the first transistor M1 is connected to a first power voltage ELVDD, a drain terminal thereof is connected to an anode of the OLED, and a gate terminal thereof is connected to a first node N1. A source terminal of the second transistor M2 is connected to a data line Dm, a drain terminal thereof is connected to the first node N1, and a gate terminal thereof is connected to a scan line Sn. A first terminal of the capacitor Cst is connected to the first power voltage ELVDD, and a second terminal thereof is connected to the first node N1. The OLED includes the anode terminal, a cathode terminal, and an emission layer. The anode terminal of the OLED is connected to the drain terminal of the first transistor M1, and the cathode terminal thereof is connected to a second power voltage ELVSS. If a current flows from the anode terminal of the OLED to the cathode terminal thereof, the emission layer thereof emits light according to the amount of the current. Equation 1 indicates the current that flows in the drain terminal of the first transistor M1.

$$I_d = \frac{\beta}{2}(ELVDD - Vdata - Vth)^2 \quad \text{[Equation 1]}$$

wherein, Id denotes the current that flows in the drain terminal of the first transistor M1, Vdata denotes a voltage of a data signal, ELVDD denotes the first power voltage applied to the source terminal of the first transistor M1, Vth denotes a threshold voltage of the first transistor M1, and β denotes a constant.

Figure 2:
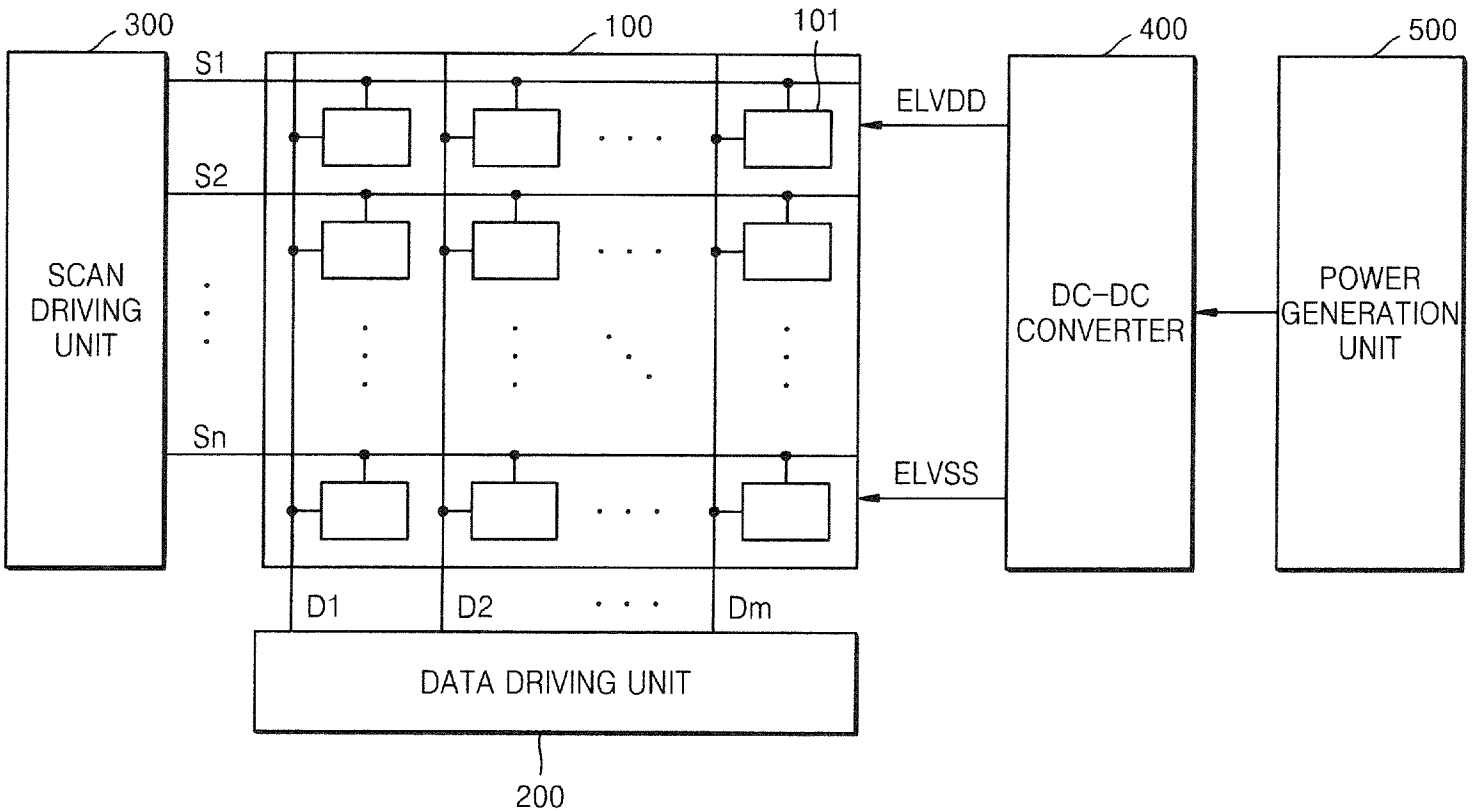
FIG. 2 is a plan view of an organic light-emitting display device according to an embodiment of the present invention.

Turning now to FIG. 2, FIG. 2 is a plan view of an organic light-emitting display device according to an embodiment of the present invention. Referring to FIG. 2, the organic light-emitting display device includes an image display unit 100, a data driving unit 200, a scan driving unit 300, and a DC-DC converter 400.

A plurality of pixels 101 as illustrated in FIG. 1 are arranged in the image display unit 100 and each includes an OLED that emits light according to the current flow. The image display unit 100 includes n scan lines S1, S2, Sn-1, and Sn that are arranged in a row direction and transmit scan signals, and m data lines D1, D2, Dm-1, and Dm that are arranged in a column direction and transmit data signals. The image pixel unit 100 is driven by receiving the first power voltage ELVDD and the second power voltage ELVSS from the outside. Therefore, the image display unit 100 emits light via the OLEDs to display an image according to the scan signals, the data signals, the first power voltage ELVDD, and the second power voltage ELVSS. In the present embodiment, the image pixel unit 100 is large in size and is included in a large-size display panel.

The data driving unit 200 receives video data having red, blue, and green components, generates the data signals and applies the data signals to the image display unit 100. The data driving unit 200 is connected to the m data lines D1, D2, Dm-1, and Dm of the image pixel unit 100 to apply the generated data signals to the image display unit 100.

The scan driving unit 300 applies scan signals to the image display unit 100 and is connected to the n scan lines S1, S2, Sn-1, and Sn that transmits the scan signals to a specific row of the image display unit 100. The pixels 101 that have received the scan signals also receive the data signals from the data driving unit 200, generate a driving current Id, and allow the driving current Id to flow through the OLEDs.

The DC-DC converter 400 receives a voltage from a power generation unit 500, changes a level of the received voltage, generates the first power voltage ELVDD and the second power voltage ELVSS suitable for the image display unit 100, and transmits the generated first power voltage ELVDD and second power voltage ELVSS to the image display unit 100. The DC-DC converter 400 includes a regulator as well as a boost circuit for generating the first power voltage ELVDD and an inverter for generating the second power voltage ELVSS.

Figure 3:
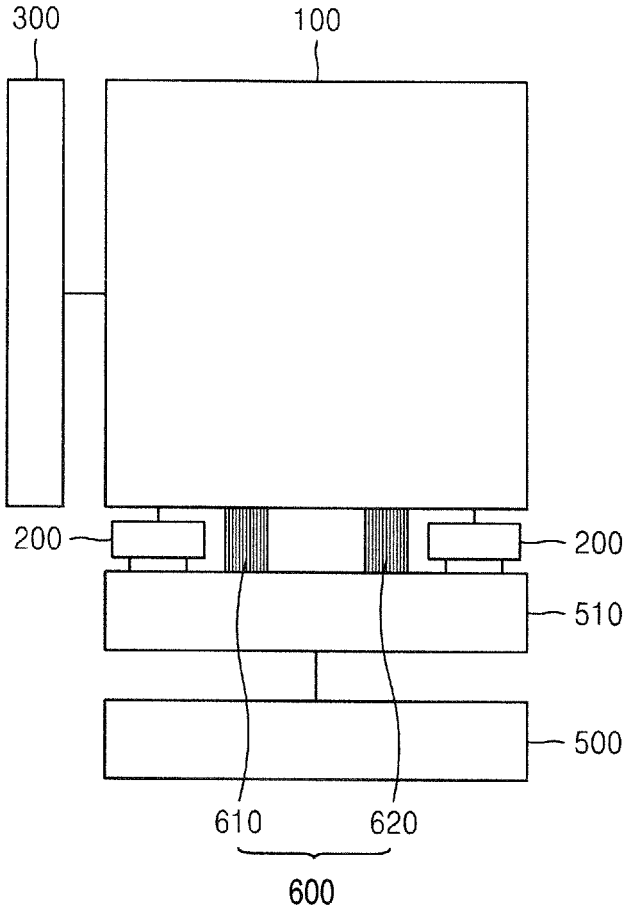
FIG. 3 is a schematic diagram of a structure of a front surface of an organic light-emitting display device according to an embodiment of the present invention.

Turning now to FIG. 3, FIG. 3 is a schematic diagram of a structure of a front surface of an organic light-emitting display device according to an embodiment of the present invention. Referring to FIG. 3, the data driving unit 200 that supplies data signals to the image display unit 100 is arranged on the lower surface of the image display unit 100 as a chip on panel (COP), however, the present invention is not limited thereto. The data driving unit 200 may be arranged outside the panel (not shown) and be connected to the panel through a film type connection device. In this regard, the panel includes the image display unit 100 corresponding to a display region and a non-display region surrounding the display region.

The scan driving unit 300 is arranged on a side surface of the image display unit 100 as a COP, however, the present invention is not limited thereto. The scan driving unit 300 may be formed outside a panel and connected to the panel through the film type connection device. The image display unit 100 receives the data signals and the scan signals from the data driving unit 200 and the scan driving unit 300, respectively.

The power generation unit 500 is arranged outside the panel, generates a voltage, and transmits the generated voltage to a DC-DC converter (not shown) via a source printed circuit board (PCB) 510 through the film type connection device 600.

Figure 4:
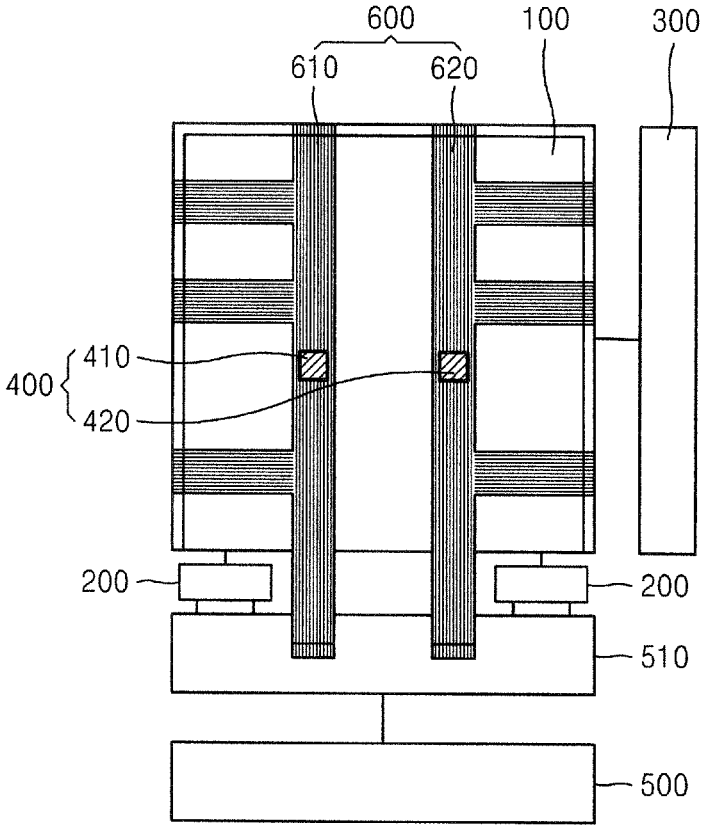
FIG. 4 is a schematic diagram of a structure of a rear surface of the organic light-emitting display device of FIG. 3 according to a first embodiment of the present invention.

Turning now to FIG. 4, FIG. 4 is a schematic diagram of a structure of a rear surface of the organic light-emitting display device of FIG. 3 according to a first embodiment of the present invention. Referring to FIG. 4, the film type connection device 600 is electrically connected to the source PCB 510 and the image display unit 100. The film type connection device 600 may be a flexible printed circuit board (FPCB) or a tape carrier package (TCP). The shape and number of the film type connection device 600 as shown in FIG. 4 are not limited thereto and may be realized in various ways.

The DC-DC converter 400 is mounted on the film type connection device 600. The DC-DC converter 400 changes the level voltage of the voltage received from the power generation unit 500 and generates the first power voltage ELVDD and the second power voltage ELVSS suitable for the image display unit 100. The DC-DC converter 400 transmits the generated first power voltage ELVDD and second power voltage ELVSS to the image display unit 100. The first power voltage ELVDD and the second power voltage ELVSS are supplied to the pixels 101 as driving voltages to cause the OLEDs to emit light.

A typical DC-DC converter is disposed outside a panel. Thus, a driving voltage generated by a typical DC-DC converter is applied to an image display unit via a source PCB through a film type connection device. In this regard, a long distance between the DC-DC converter and the image display unit causes the occurrence of a large IR voltage drop. The larger the image display unit, the greater the IR drop. According to an experiment, a voltage applied to an image display unit of about 40 inches is measured to be smaller than a voltage supplied by the DC-DC converter by 2V. This adversely affects long range uniformity (LRU) of the organic light-emitting display device.

However, referring to FIGS. 3 and 4, the DC-DC converter 400 arranged so that it is closer to the image display unit 100 so that the first power voltage ELVDD and the second power voltage ELVSS are supplied to the image display unit 100 through the film type connection device 600. A short distance between the DC-DC converter 400 and the image display unit 100 reduces the occurrence of the IR drop. Thus, the LRU of the organic light-emitting display device is improved.

The organic light-emitting display device of the first embodiment may include a plurality of film type connection devices 600 and a plurality of DC-DC converters 400 mounted on the film type connection devices 600. Referring to FIG. 4, the organic light-emitting display device of the first embodiment may include a first film type connection device 610, a second film type connection device 620, a first DC-DC converter 410, and a second DC-DC converter 420, however the present invention is not limited thereto as a single DC-DC converter may be mounted on a single film type connection device and still be within the scope of the present invention.

The first DC-DC converter 410 is mounted on the first film type connection device 610 corresponding to the center of the image display unit 100 as shown in FIG. 4. The second DC-DC converter 420 is mounted on the second film type connection device 620 also corresponding to the center of the image display unit 100. The first power voltage ELVDD and the second power voltage ELVSS that are output from the first and second DC-DC converters 410 and 420 are supplied to the image display unit 100. In the present embodiment, since the DC-DC converter 400 is disposed to correspond to the center of the image display unit 100, the distance between the DC-DC converter 400 and the image display unit 100 does not vary much between pixels, thereby applying the driving voltage output from the DC-DC converter 400 to the image display unit 100 uniformly.

The first and second DC-DC converters 410 and 420 control the first power voltage ELVDD and the second power voltage ELVSS supplied to the image display unit 100 to maintain static voltages. Maintenance of static voltages may be achieved in various ways. For example, the first DC-DC converter 410 feed backs the first power voltage ELVDD output from the first DC-DC converter 410 and detects and controls an output voltage. Further, the first and second DC-DC converters 410 and 420 perform a phase control operation to supply a voltage and current of the same size to the image display unit 100, respectively.

Figure 5:
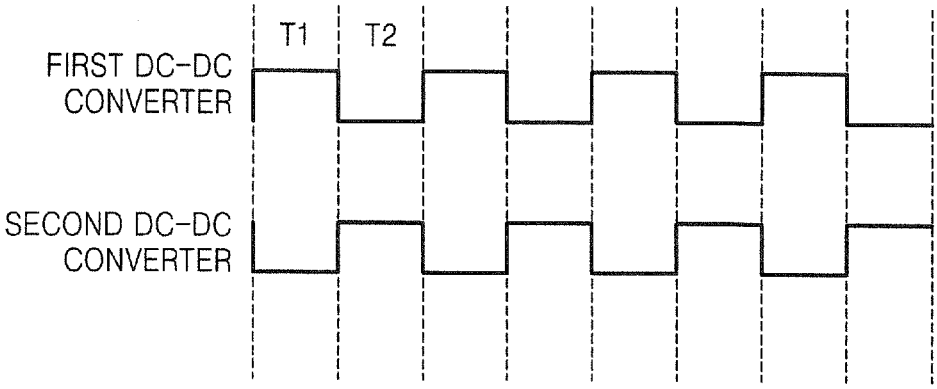
FIG. 5 is a timing diagram of a phase control operation performed by first and second DC-DC converters according to the first embodiment of the present invention.

Turning now to FIG. 5, FIG. 5 is a timing diagram of a phase control operation performed by the first and second DC-DC converters 410 and 420 according to the first embodiment of the present invention. Referring to FIG. 5, it is assumed that the first and second DC-DC converters 410 and 420 supply a voltage of 10 V to the image display unit 100. During the phase control operation, the first DC-DC converter 410 outputs a voltage of 5V during a first driving period T1, and the second DC-DC converter 420 outputs a voltage of 0V during the first driving period T1. If the second DC-DC converter 420 outputs a voltage of 5V during a second driving period T2, the first DC-DC converter 410 outputs a voltage of 0V during the second driving period T2. In more detail, an output voltage waveform of the second DC-DC converter 420 is phase-delayed by 180 degrees as compared to an output voltage waveform of the first DC-DC converter 410. The phase control operation is to phase-delay output voltage waveforms of the plurality of DC-DC converters 400 and output voltages thereof according to Equation 2 below. Since the first and second driving periods T1 and T2 are merely several microseconds (μs) in duration, a voltage of 10V is supplied to the image display unit 100. As described above, the plurality of DC-DC converters 400 may uniformly distribute the load of the image display unit 100 through phase control.

$$phasedelay(indegrees) = \frac{360^\circ}{\text{Number of } DC-DCconverters} \quad \text{[Equation 2]}$$

Figure 6:
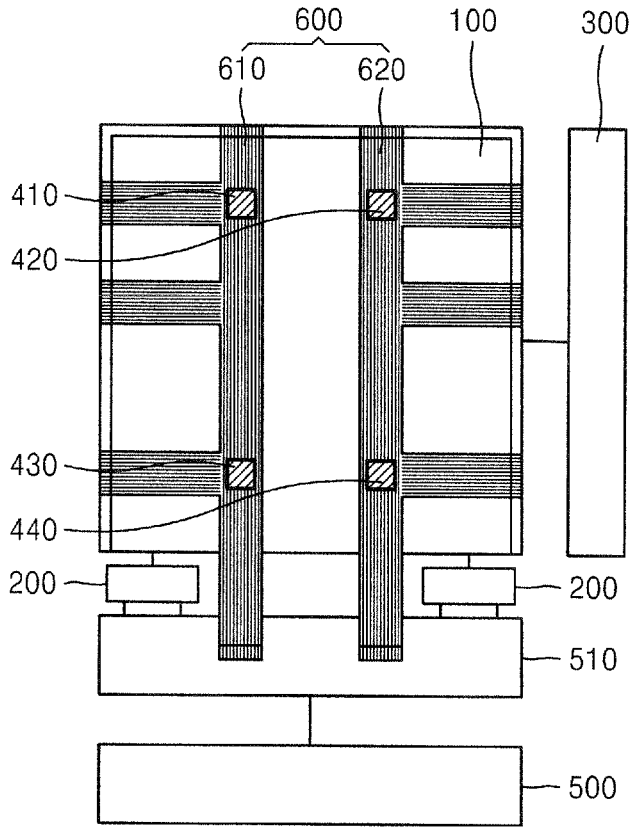
FIG. 6 is a schematic diagram of a structure of a rear surface of the organic light-emitting display device of FIG. 3 according to a second embodiment of the present invention.

Turning now to FIG. 6, FIG. 6 is a schematic diagram of a structure of a rear surface of the organic light-emitting display device of FIG. 3 according to a second embodiment of the present invention. Referring to FIG. 6, the organic light-emitting display device of the second embodiment may include a first film type connection device 610, a second film type connection device 620, a first DC-DC converter 410, a second DC-DC converter 420, a third DC-DC converter 430, and a fourth DC-DC converter 440. A plurality of DC-DC converters may be mounted on a single film type connection device.

The first DC-DC converter 410 and the third DC-DC converter 430 are mounted on the first film type connection device 610 corresponding to an edge of the image display unit 100. The second DC-DC converter 420 and the fourth DC-DC converter 440 are mounted on the second film type connection device 620 corresponding to the edge of the image display unit 100. The first power voltage ELVDD and the second power voltage ELVSS that are output from the first through fourth DC-DC converters 410, 420, 430, and 440 are supplied to the image display unit 100. In the present embodiment, since the first through fourth DC-DC converters 410, 420, 430, and 440 are disposed to correspond to the edge of the image display unit 100, the distance between the first through fourth DC-DC converters 410, 420, 430, and 440 and the image display unit 100 is very short, thereby reducing the IR drop.

The first through fourth DC-DC converters 410, 420, 430, and 440 control the first power voltage ELVDD and the second power voltage ELVSS supplied to the image display unit 100 and maintain static voltages. Maintenance of static voltages is achieved in various ways and a detailed description thereof is not repeated here. The first through fourth DC-DC converters 410, 420, 430, and 440 also perform a phase control operation to supply a voltage and a current of the same size to the image display unit 100, respectively.

Figure 7:
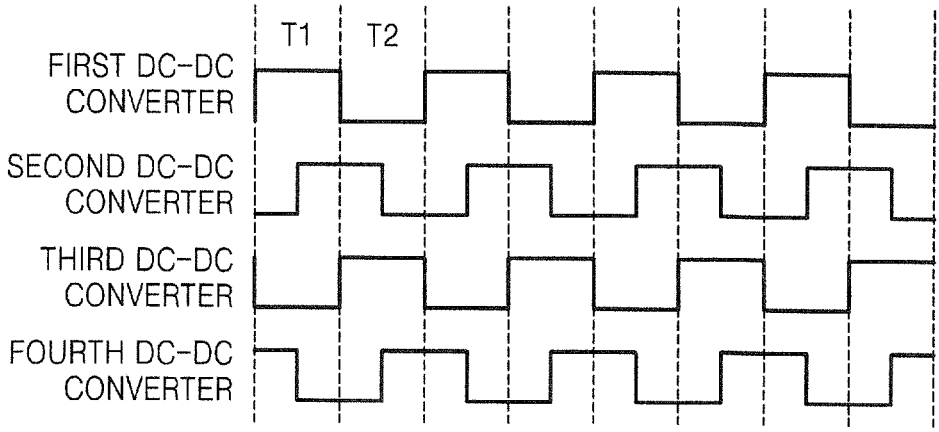
FIG. 7 is a timing diagram of a phase control operation performed by first through fourth DC-DC converters according to the fourth embodiment of the present invention.

Turning now to FIG. 7, FIG. 7 is a timing diagram of a phase control operation performed by first through fourth DC-DC converters according to the second embodiment of the present invention. Referring to FIG. 7, it is assumed that the first through fourth DC-DC converters 410, 420, 430, and 440 supply a voltage of 10 V to the image display unit 100. During the phase control operation, the first through fourth DC-DC converters 410, 420, 430, and 440 each output a voltage of 2.5V, respectively. An output voltage waveform of the second DC-DC converter 420 is phase-delayed by 90 degrees as compared to an output voltage waveform of the first DC-DC converter 410. An output voltage waveform of the third DC-DC converter 430 is phase-delayed by 180 degrees as compared to the output voltage waveform of the first DC-DC converter 410. An output voltage waveform of the fourth DC-DC converter 440 is phase-delayed by 270 degrees as compared to the output voltage waveform of the first DC-DC converter 410. As described above, the first through fourth DC-DC converters 410, 420, 430, and 440 may uniformly distribute the load to the image display unit 100 through phase control.

The number of DC-DC converters, the locations where the DC-DC converters are mounted, the number of film type connection devices, and the shapes and sizes of the film type connection devices shown in FIGS. 4 through 6 are not limited thereto. As long as the DC-DC converters, which are the core of the present invention, are mounted on the film type connection devices and supply driving voltages to the image display unit, various changes in form and detail may be made by one having ordinary skill in the art and still be within the scope of the present invention as defined by the appended claims.

According to the embodiments of the present invention, a plurality of DC-DC converters are mounted on a film type connection device which is electrically connected to an image display unit, which solves the IR drop problem and improves the LRU of an organic light-emitting display device, thereby allowing for the manufacture of a large-size organic light-emitting device.

While the present invention has been particularly shown and described with reference to exemplary embodiments thereof, it will be understood by one of ordinary skill in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

All references, including publications, patent applications, and patents, cited herein are hereby incorporated by reference to the same extent as if each reference were individually and specifically indicated to be incorporated by reference and were set forth in its entirety herein.

What is claimed is:

1. An organic light-emitting display device, comprising:

an image display unit including a plurality of pixels defined by a plurality of scan lines and a plurality of data lines, the image display unit having a front surface that displays an image and a rear surface opposite the front surface, and the image display unit having a plurality of peripheral edges;

a first film type connection device and a second film type connection device arranged on the rear surface of the image display unit and being electrically connected to a different combination of at least two of the plurality edges of the image display unit; and a first DC-DC converter arranged on the first film type connection device and a second DC-DC converter arranged on the second film type connection device on the rear surface of the image display unit, wherein each of the first and second DC-DC converters supply driving voltages to the image display unit through multiple paths in the first and second film type connection devices, wherein each of the first and second DC-DC converters is adapted to perform a phase control operation by supplying corresponding identical but phase shifted waveforms to the image display unit.

2. The organic light-emitting display device of claim 1, each of the first and second DC-DC converters supplies a first power voltage and a second power voltage to the image display unit.

3. The organic light-emitting display device of claim 2, wherein each of the first and second DC-DC converters generates the first power voltage and the second power voltage by being electrically connected to a power generation unit and by receiving a voltage output from the power generation unit.

4. The organic light-emitting display device of claim 1, wherein each of the first and second DC-DC converters is arranged at a location that corresponds to a center of the image display unit.

5. The organic light-emitting display device of claim 1, wherein each of the first and second DC-DC converters is arranged at a location that corresponds to one of the plurality of edges of the image display unit.

6. The organic light-emitting display device of claim 2, each of the first and second DC-DC converters is adapted to control the first power voltage and the second power voltage that are supplied to the image display unit and to maintain steady, regulated voltages.

7. The organic light-emitting display device of claim 1, wherein each of the first and second film type connection devices are selected from a group consisting of flexible printed circuit boards (FPCBs) and tape carrier packages (TCPs).

8. The organic light-emitting display device of claim 1, wherein the image display unit is included in a large size display panel of greater than 40 inches.

9. The organic light-emitting display device of claim 1, further comprising a third DC-DC converter arranged on the first film type connection device and a fourth DC-DC converter arranged on the second film type connection device.

10. The organic light-emitting display device of claim 9, an output voltage waveform of the second DC-DC converter being phase delayed by 90 degrees compared to an output voltage waveform of the first DC-DC converter.

11. The organic light-emitting display device of claim 3, wherein the power generation unit is external to the image display unit, each of the first and second DC-DC converters is electrically connected to the power generation unit by the first and second film type connection devices, respectively.

12. The organic light-emitting display device of claim 4, wherein an output voltage waveform of the second DC-DC converter is phase-delayed by 180 degrees as compared to an output voltage waveform of the first DC-DC converter.

13. The organic light-emitting display device of claim 5, further comprising:

a third DC-DC converter arranged on the first film type connection device; and a fourth DC-DC converter arranged on the second film type connection device, wherein an output voltage waveform of the second DC-DC converter is phase-delayed by 90 degrees as compared to an output voltage waveform of the first DC-DC converter, and an output voltage waveform of the third DC-DC converter is phase-delayed by 180 degrees as compared to the output voltage waveform of the first DC-DC converter, and an output voltage waveform of the fourth DC-DC converter is phase-delayed by 270 degrees as compared to the output voltage waveform of the first DC-DC converter.

14. The organic light-emitting display device of claim 2, comprised of the image display unit disposed to emit light according to the first power voltage, the second power voltage, scan signals from the scan lines and data signals from the data lines.

15. The organic light-emitting display device of claim 14, further comprising:

a scan driving unit external to the image display unit to provide the scan signals to the scan lines;

a data driving unit external to the image display unit to provide the data signals to the data lines; and a power generation unit external to the image display unit to supply an input voltage to the first and second DC-DC converters.

16. The organic light-emitting display device of claim 1, further comprising:

a scan driving unit external to the image display unit to provide scan signals to the scan lines;

a data driving unit external to the image display unit to provide data signals to the data lines; and a power generation unit external to the image display unit to supply an input source voltage to the first and second DC-DC converters.

17. The organic light-emitting display device of claim 2, each of the first and second DC-DC converters include a voltage regulator and a boost circuit to convert a source voltage received from a power generation unit into the first power voltage and the second power voltage.

* * * * *